United States Patent [19]

Ikesue et al.

[11] 4,449,810

[45] May 22, 1984

[54] ELECTROPHOTOGRAPHIC COPYING MACHINE WITH MEANS FOR MIXING AND REMOVING TONER AND AN INTEGRAL EXPOSURE PLATE

[75] Inventors: Masumi Ikesue, Tokyo; Nobuyuki Yanagawa, Chigasaki, both of Japan

[73] Assignee: Ricoh Company, Ltd., Japan

[21] Appl. No.: 397,229

[22] Filed: Jul. 12, 1982

[30] Foreign Application Priority Data

Jul. 10, 1981 [JP] Japan ..... 56-107798
Jul. 15, 1981 [JP] Japan ..... 56-110353

[51] Int. Cl.[3] ..... G03G 15/09

[52] U.S. Cl. ..... 355/3 DD; 118/658; 355/71

[58] Field of Search ..... 355/3 DD, 3 R, 14 E, 355/71; 118/656–658, 261, 413; 430/122

[56] References Cited

U.S. PATENT DOCUMENTS

| | | | |
|---|---|---|---|
| 3,764,208 | 10/1973 | Takahashi et al. | 355/3 DD |
| 3,926,517 | 12/1975 | Nagahara | 355/3 DD |
| 3,985,436 | 10/1976 | Tanaka et al. | 355/3 DD |
| 4,021,108 | 5/1977 | Ozaki et al. | 355/3 R |
| 4,194,465 | 3/1980 | Tsukamoto et al. | 355/3 DD |
| 4,286,861 | 9/1981 | Matsumoto et al. | 355/3 DD |
| 4,321,886 | 3/1982 | Azuma | 355/3 DD |

*Primary Examiner*—R. L. Moses
*Attorney, Agent, or Firm*—Guy W. Shoup

[57] ABSTRACT

A dry type development apparatus comprising (1) a developer container disposed near a latent-electrostatic-image-bearing photoconductor, a development roller, disposed within the developer container, comprising a rotatable non-magnetic sleeve and inner magnets, for supplying the toner to the photoconductor for development of the latent images, a rotatable bucket wheel for supplying the toner to the development roller, a doctor blade for forming on the development roller a toner layer with a predetermined thickness by scraping the excess toner off the toner layer; and (6) a separator which extends over the bucket wheel and guides the toner scraped off by the doctor blade onto the bucket wheel or to the developer container, includes the improvement wherein the development roller and the bucket wheel are rotated in the same direction, and the toner flows from the lower portion of the developer roller to the bucket wheel, then towards the upper portion of the development roller, and, of the toner transferred from the bucket wheel to the development roller, the toner scraped off the toner layer by the doctor blade is carried onto the separator, and is returned onto the bucket wheel or to the developer container, and, in the meantime, the toner deposited on the development roller is carried to the development portion of the photoconductor for development of latent electrostatic images, and the excess toner which is not used for the development is carried below the development roller.

A slit exposure plate for forming latent electrostatic images on the surface of the photoconductor is integral with a development unit which integrally includes at least a developer container and a development roller and which is detachable from and reattachable to the body of the development apparatus.

10 Claims, 11 Drawing Figures

ELECTROPHOTOGRAPHIC COPYING MACHINE WITH MEANS FOR MIXING AND REMOVING TONER AND AN INTEGRAL EXPOSURE PLATEpcl

BACKGROUND OF THE INVENTION

The present invention relates to a dry type development apparatus of an electrophotographic copying machine, and more particularly to a dry type development apparatus which is capable of efficiently performing the mixing of a two-component type developer, without causing deterioration of the developer by such mixing, and in which a development unit, including a development roller for supplying a two-component type toner (i.e., the developer) to a photoconductor, a bucket wheel for supplying the toner to the development roller, a developer container for holding the toner therein, a doctor blade for regulating the thickness of the toner layer deposited on the development roller, and a separator for returning the toner scraped by the doctor blade off the toner layer deposited on the development roller to the bucket wheel or to the developer container, is integrally attached to an attachment plate together with a slit exposure plate, with high assembling accuracy with respect to a photoconductor of the development apparatus, and the development unit and the slit exposure plate are integrally detachable from the development apparatus.

In the development apparatus of conventional electro-photographic copying machines, a development roller for supplying a developer to a photoconductor drum is disposed in proximity to the photoconductor drum, and a bucket wheel for supplying the developer to the development roller is disposed in proximity to the development roller. The development roller and the bucket wheel are rotated in opposite directions, thereby supplying the developer from the bucket wheel to the photoconductor drum and developing latent electrostatic images formed on the surface of the photoconductor drum.

In the conventional development apparatus, new developer supplied from a developer replenishment tank cannot always be uniformly mixed with old developer which has passed over the surface of the photoconductor drum or which has stood for a period of time in the developer container of the development apparatus. If such mixing is not done properly, the development cannot be performed uniformly, and images with uniform image density cannot be obtained.

Furthermore, in the conventional development apparatus, the development roller and the bucket wheel are disposed side by side with a certain space therebetween, rotated in opposite directions and operate so as to force the developer into the space between the development roller and the bucket wheel, retarding their movement and requiring within the development apparatus a great drive force for rotation of the development roller and the bucket wheel. Accordingly, high pressure is applied to the developer and heat is generated due to the friction between the particles of the developer under application of that high pressure, so that the developer is prematurely deteriorated.

Generally, in the development apparatus for use in an electrophotographic copying machine, it is necessary that a slit exposure plate, by which latent electrostatic images are formed on the electrically charged surface of a photoconductor drum, be disposed with high assembling accuracy relative to the photoconductor drum, and the center of the slit exposure plate be accurately positioned in the center of the light path for exposure. However, the slit exposure plate is long and narrow in comparison with other parts of the development apparatus, and it is not easy to set such a slit exposure plate at a predetermined position with such high accuracy. Its assembling position is also a particularly difficult position in the development apparatus due to the limited space for the slit exposure plate. In other words, the assembling and disassembling of the slit exposure plate are difficult in comparison with other parts of the development apparatus.

SUMMARY OF THE INVENTION

It is therefore an object of the present invention to provide a dry type development apparatus of an electro-photographic copying machine, which is capable of mixing the developer smoothly and effectively without causing deterioration of the developer in the course of the mixing.

According to the present invention, this object is attained by a dry type development apparatus comprising (1) a developer container for holding a two-component type toner therein, disposed near a photoconductor on which latent electrostatic images are formed, (2) a developer replenishment tank from which new two-component type toner is replenished to the developer container, (3) a development roller, disposed within the developer container, comprising a rotatable non-magnetic sleeve and inner magnets which are supported stationarily within the non-magnetic sleeve, the non-magnetic sleeve directed towards the peripheral surface of the photoconductor and capable of forming a magnetic brush thereon from which the toner is supplied to the latent-electrostatic-images-bearihg photoconductor for development of the latent images during the rotation of the non-magnetic sleeve, (4) a bucket wheel disposed near the development roller in the developer container, for supplying the toner to the development roller, rotating in the same direction as that of the development roller, and comprising a rotatable wheel and a plurality of buckets attached to the peripheral surface of the wheel, the buckets capable of scooping up the toner which flows from a lower portion of the development roller along the bottom of the developer container and capable of supplying the scooped up toner to the development roller, (5) a doctor blade which is fixed to a stationary portion of the development apparatus and is directed towards the peripheral surface of the development roller so as to form a toner layer with a predetermined thickness on the development roller by scraping the excess toner off the development roller, and (6) a separator which is disposed near the doctor blade and extends over the bucket wheel in order to guide the toner scraped off by the doctor blade onto the bucket wheel or to the developer container. Thus, the toner flows from the lower portion of the developer roller to the lower buckets of the bucket wheel and is then carried upwards by the bucket wheel towards the upper portion of the development roller. Of the toner transferred from the bucket wheel to the development roller, the toner scraped off the toner layer by the doctor blade is carried onto the separator, and is returned onto the bucket wheel or to the developer container. In the meantime, the toner deposited in the form of a toner layer on the development roller is carried to the development portion of the photoconductor and is partly used for development of latent electrostatic images formed on the photoconductor. The excess toner which is not used for the development is carried below the development roller and is then carried along the bottom of the developer container towards the bucket wheel.

Another object of the present invention is to provide a dry type development apparatus of the above-mentioned type in which a slit exposure plate is disposed integrally with a development unit including the above-described development roller, bucket wheel, developer container, developer separator and doctor blade. The slit exposure plate is detachable from the development apparatus, integrally with the development unit, wherein the slit exposure plate is disposed with high assembling accuracy with respect to a photoconductor and is detachable from and reattachable to the development apparatus without disturbing the high assembling accuracy with respect to the photoconductor, for instance, when cleaning the development apparatus or for other maintenance thereof.

DETAILED DESCRIPTION OF THE PREFERRED EMBODIMENTS

Figure 1:
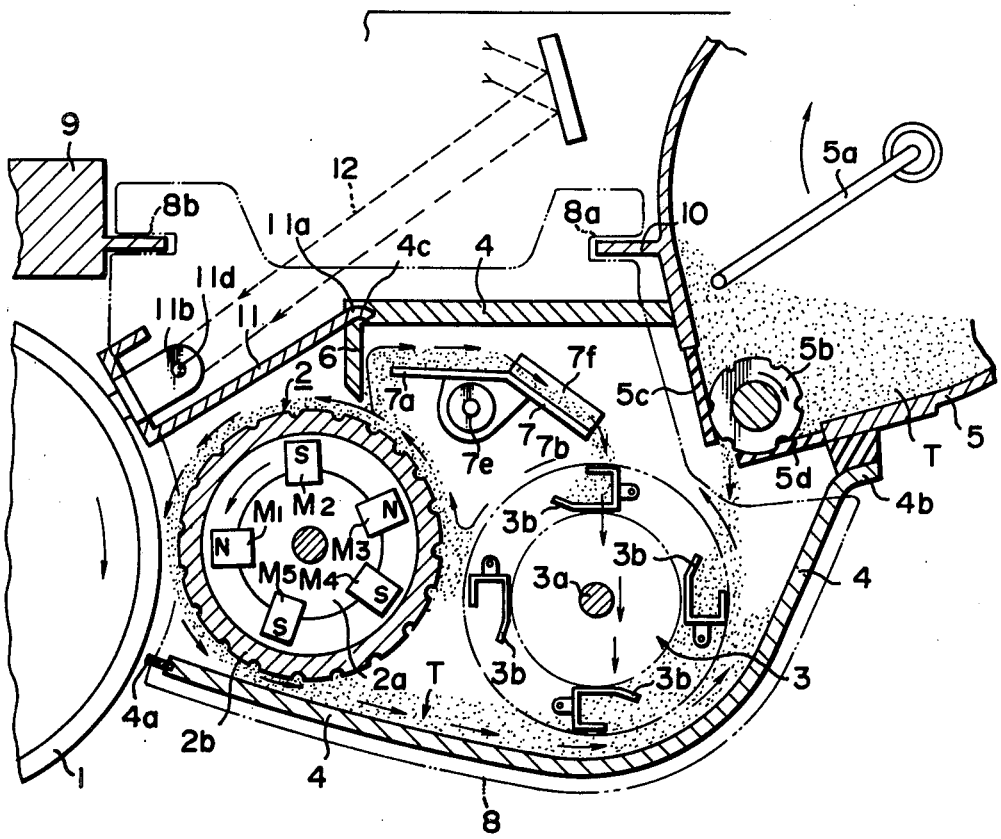
FIG. 1 is a schematic cross section of an embodiment of a dry type development apparatus according to the present invention.

Referring to FIG. 1, there is shown a schematic cross section of an embodiment of a dry type development apparatus according to the present invention.

In the figure, reference numeral 1 indicates a drum-shaped photoconductor (hereinafter referred to as the photoconductor drum), which is rotated clockwise.

In proximity to a portion of the peripheral surface of the photoconductor drum 1, there is disposed a development roller 2. Thus, an image development section is formed between the photoconductor drum 1 and the development roller 2. The development roller 2 extends in the direction perpendicular to the plane of FIG. 1 and comprises a fixed cylindrical support member 2*a* for supporting inner magnets $M_1$, $M_2$, $M_3$, $M_4$ and $M_5$, and a rotatable non-magnetic sleeve 2*b* which is disposed so as to be rotatable around those inner magnets. As shown in FIG. 1, the inner magnets $M_1$, $M_2$, $M_3$, $M_4$ and $M_5$ are radially arranged and supported with predetermined spaces therebetween by the cylindrical support member 2*a*, directed towards the inner peripheral surface of the non-magnetic sleeve 2*b*. More specifically, the magnet $M_1$ is disposed with its N pole directed towards the peripheral surface of the photoconductor drum 1. The magnets $M_2$, $M_4$ and $M_5$ are disposed with their S poles directed towards the inner peripheral surface of the non-magnetic sleeve 2*b*, while the magnet $M_3$ is disposed with its N pole directed towards the inner peripheral surface of the non-magnetic sleeve 2*b*.

Adjacent to the development roller 2, on the right side thereof, there is disposed a bucket wheel 3 which bears at the outer peripheral surface thereof a plurality of buckets 3*b*, with the openings of the buckets 3*b* extending parallel to the axis 3*a* of the bucket wheel 3 along the peripheral surface of the bucket wheel 3.

Both the development roller 2 and the bucket wheel 3 are rotated counterclockwise.

Reference numeral 4 indicates a developer container. The bottom of the developer container 4 is inclined in such a manner that the developer contained in the developer container 4 gravitates down along the bottom of the developer container 4 from under the development roller 2 to under the bucket wheel 3. One end portion of the bottom of the developer container 4 extends towards the surface of the photoconductor drum 1 and includes a buffer member 4*a* at the top portion thereof. The buffer member 4*a* also serves as a sealing member for preventing the developer from being airborne from the gap between the photoconductor drum 1 and the developer container 4. The opposite portion of the bottom of the developer container 4, with respect to said one end portion thereof, extends with a curvature so as to maintain a predetermined space between the maximum rotatable range of the bucket wheel 3 and the bottom of the developer container 4, then upwards away from the bucket wheel 3, and its extreme end portion is connected to a developer replenishment tank 5.

In the present invention, as the developer, a two-component type toner is employed. In the developer replenishment tank 5, a supply of the toner T is held. The toner T held in the developer replenishment tank 5 is mixed uniformly by an agitator 5*a* and is supplied to the developer container 4 or to the buckets 3*a* of the bucket wheel 3 by the rotation of a toner supply roller 5*b* with grooves formed on the peripheral surface thereof, which is disposed at the outlet portion of the developer replenishment tank 5. Reference numerals 5*c* and 5*d* indicate elastic sealing members disposed at the outlet portion of the developer replenishment tank 5.

A doctor blade 6 is disposed with the tip thereof directed towards the outer peripheral surface of the non-magnetic sleeve 2*b* of the development roller 2, with a predetermined space therebetween, at an upper and right side position with respect to the development roller 2, almost midway between the inner magnets $M_2$ and $M_3$ as shown in FIG. 1. The doctor blade 6 serves to regulate the thickness of the toner layer deposited on the non-magnetic sleeve 2*b*.

Near the doctor blade 6, there is disposed a developer separator 7 which extends from above the development roller 2 to above the bucket wheel 3. One end portion 7*a* of the developer separator 7 is directed towards the raked surface of the doctor blade 6. The developer separator 7 is slightly turned down from the middle, and the other end portion 7*b* extends over the bucket wheel 3 to above the drive shaft 3*a* of the bucket wheel 3.

Reference numeral 12 indicates the rays of exposure light for latent electrostatic image formation on the surface of the photoconductor drum 1.

The development process including developer supply and mixing thereof in this development apparatus will now be explained.

In the development process, the toner T is supplied to the photoconductor drum 1 via a magnetic brush formed on the peripheral surface of the non-magnetic sleeve 2*b* , at the previously described image development section. In that section, the peripheral surface portion of the non-magnetic sleeve 2*a* is rotated in the same direction as the peripheral portion of the photoconductor drum 1.

The residual toner on the non-magnetic sleeve 2*b* is moved over the magnet $M_1$and then over the magnet $M_5$ as the non-magnetic sleeve 2*b* is rotated. When, with further rotation of the non-magnetic sleeve 2*b* , the residual toner comes over the magnet $M_4$, the residual toner is caused to come off the surface of the non-magnetic sleeve 2*b* due to the magnetic repulsion applied to the residual toner by the magnets $M_5$ and $M_4$ which are arranged so as to be positioned side by side and to direct the same magnetic poles S towards the non-magnetic sleeve 2*b* . As a result, the toner is dropped onto the bottom surface of the developer container 4 and then gravitates along the bottom surface of the developer container 4 to the gap between the bottom of the developer container 4 and the bucket wheel 3. The toner is moved towards the bucket wheel 3 along the bottom surface of the developer container 4 due to the inclination of the bottom surface and by the force applied to the dropped toner by the rotating development roller 2 in the direction towards the bucket wheel 3.

The toner carried between the bucket wheel 3 and the bottom surface of the developer container 4 is scooped up by the buckets 3*b* as the bucket wheel 3 is rotated, and is then carried towards the development roller 2. When the buckets 3*b* come to a portion where the bucket wheel 3 faces the peripheral surface of the development roller 2, the buckets 3*b* are turned upside down, so that the toner is poured over the development roller 2 and part of the toner is magnetically attracted to the non-magnetic sleeve 2*b* . The toner which is not attracted to the non-magnetic sleeve 2*b* falls to the bottom of the developer container 4 and is mixed with the toner which is on the way from the lower portion of the development roller 2 to the bucket wheel 3 and is then scooped up by the bucket wheel 3.

In the above, since the development roller 2 and the bucket wheel 3 are rotated in the same direction, that is, counterclockwise, it does not occur that the toner is forced into the gap between the development roller 2 and the bucket wheel 3 when the toner is transferred from the bucket wheel 3 to the development roller 2. Rather, the toner is smoothly transferred along the upper portions of the development roller 2. Therefore, no adverse pressure is applied to the toner when the toner is transferred from the bucket wheel 3 to the development roller 2.

The toner transferred to the development roller 2 is carried to the photoconductor drum 1, while regulated in thickness by the doctor blade 6, as the non-magnetic sleeve 2*b* is rotated.

The toner scraped off by the doctor blade 6 in the course of the thickness regulation of the toner deposited on the development roller 2 is moved upwards along the top of the raked surface of the doctor blade 6 onto the separator 7 in the direction as shown by the arrows, and finally falls onto the bucket wheel 3. Part of the falling toner is received by the buckets 3*b*. But most of the toner is returned to the developer container 4 and is mixed with the remaining toner in the developer container 4 by the bucket wheel 3.

In the above described embodiment of a dry type development apparatus according to the present invention, the residual toner on the non-magnetic sleeve 2*b* of the development roller 2 is caused to come off the surface thereof in the portion between the magnets $M_5$ and $M_4$and is then carried towards the bucket wheel 3, by which the residual toner and fresh toner supplied from the buckets 3*b* are mixed. In the meantime, the toner recovered from the development roller 2 by the doctor blade 6 in the course of the thickness regulation of the toner layer on the nonmagnetic sleeve 2*b* , is also returned to the developer container 4 through the separator 7, whereby the mixing of the toner is securely done in this embodiment.

Further, as described previously, since the development roller 2 and the bucket wheel 3 are rotated in the same direction, it does not occur that the toner is forced into the gap between the development roller 2 and the bucket wheel 3, under application of high pressure thereto, when the toner is transferred from the bucket wheel 3 to the development roller 2. Therefore, accelerated deterioration of the toner is prevented.

Figure 2:
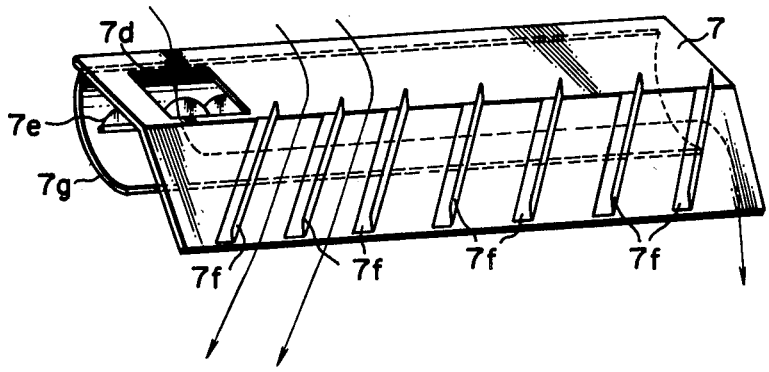
FIG. 2 is a perspective view of a separator for use in the development apparatus shown in FIG. 1.

As the separator 7, any plate can be employed if it is curved in the middle so as to allow the toner to move along the plate and to drop over the bucket wheel 3. In the present invention, however, the separator 7 as shown in FIG. 2 is particularly useful since it can mix the toner efficiently. As shown in FIG. 2, the separator 7 includes a number of fins 7*f* formed on an the upper plate. These fins 7*a* are inclined in such a direction that the toner is carried from the back side to the front side in view of FIG. 1. The toner gravitates along those inclined fins 7*f*, that is, in the direction from the back side to the front side in FIG. 1, and then falls on the bucket wheel 3.

In the front end portion of the separator 7, there is formed an opening 7*d*. Under the separator 7, there is formed a conduit 7*g* which extends along the separator 7. Inside the conduit 7*g*, there is disposed a screw conveyor 7*e*. The toner which enters the conduit 7*g* through the opening 7*d* of the separator 7 is carried along the conduit 7*g* by the rotation of the screw conveyor 7*e* in the direction of the arrow in FIG. 2, that is, referring to FIG. 1, from the front end portion of the conduit 7*g* to the back extreme end of the conduit 7*g*. Then the toner falls onto the back end portion of the bucket wheel 3 and to the back end bottom of the developer container 4. Part of the toner which has been received by the buckets 3*b* at the extreme back end portion thereof or fallen on the back end portion of the bottom of the developer container 4 is carried by the buckets 3*b* onto the development roller 2 and the other part of the toner is carried back onto the extreme back end portion of the separator 7. That toner carried onto the back portion of separator 7 is shifted to the front side in FIG. 1 by the fins 7*f* inclined to the front side. As a result, the toner falls slightly on the front side of the bucket wheel 3 or on the front side of the bottom of the developer container 4. In the repeated course of such circulation of the toner, the toner which falls from the extreme back end of the conduit 7*g* onto the extreme back end portion of the bucket wheel 3 onto the extreme back end portion of the bottom of the developer container 4 is eventually returned in part to the opening 7*d* of the separator 7. Thus the separator 7 serves not only to return the toner scraped off the toner layer on the development roller 2 to the developer container 4, but also to mix the toner effectively during the above-described circulation.

Figure 3:
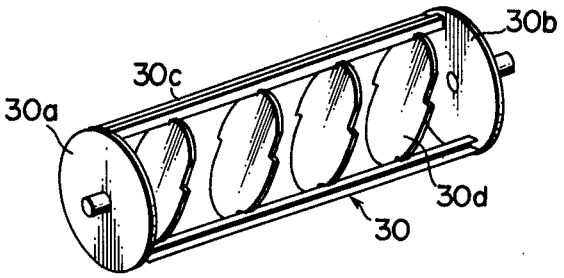
FIG. 3 is a perspective view of a modified bucket wheel for use in the present invention.

Referring to FIG. 3, there is perspectively shown a modified bucket wheel 30 for use in the present invention, which comprises a pair of flanges 30*a* and 30*b*, a bucket 30*c* by which the flanges 30*a* and 30b are connected to each other, and a plurality of elliptical plates 30d fitted in the cylindrical space of the bucket 30*c*, with predetermined spaces therebetween and with a predetermined inclination with respect to the flanges 30*a* and 30*b*. The elliptical plates 30*d* serve to mix the toner uniformly during the rotation of the bucket wheel 30.

Referring back to FIG. 1, as described previously, the doctor blade 6 is disposed at an upper and right side position with respect to the development roller 2, almost midway between the inner magnets $M_2$ and $M_3$. The reason for such arrangement of the doctor blade 6 will now be explained by referring to FIG. 4 and FIG. 5.

Figure 4:
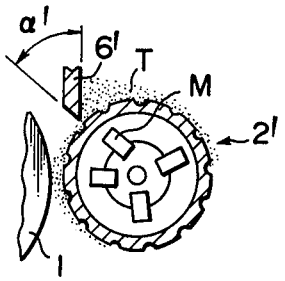
FIG. 4 PRIOR ART
FIG. 4 is a schematic cross section of a conventional doctor blade in explanation of the position of the doctor blade relative to a development roller.

FIG. 4 is a schematic cross section of a conventional doctor blade 6′ in explanation of the position of the doctor blade 6′ relative to a development roller 2′. As shown in the figure, the rake angle $\alpha'$ of the doctor blade 6′ is negative and comparatively great. Therefore, the toner T tends to accumulate in quantity on the side of the rake face of the doctor 6′. The accumulated toner T makes it difficult for the doctor blade 6′ to scrape off the toner T from the toner layer on a development sleeve 2′, and, as the toner T accumulates, more driving force is required for the rotation of the development sleeve 2′. Under such circumstances, it occurs that the doctor blade 6′ and the development sleeve 2′ are vibrated, which makes it difficult to maintain a predetermined gap between the doctor blade 6′ and the development sleeve 2′, and the toner is caused to deteriorate by the pressure applied to the toner.

Figure 5:
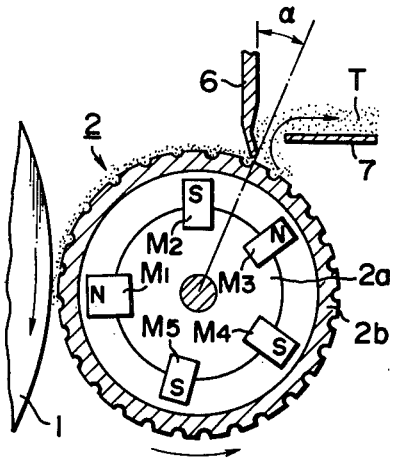
FIG. 5 is a schematic cross section of a doctor blade for use in the present invention in explanation of the position of the doctor blade relative to the development roller.

In contrast to this, in the present invention, the doctor blade 6 is disposed at an upper and right side position with respect to the development roller 2, almost midway between the inner magnets $M_2$ and $M_3$, wherein the rake angle $\alpha$ is positive and smaller than the rake angle $\alpha'$ of the conventional doctor blade 6′. By disposing the doctor blade 6 almost midway between the inner magnets $M_2$ and $M_3$, where the magnetic force of the two magnets applied to the toner is relatively weak, and by adjusting the rake angle of the doctor blade 6 as mentioned above, the smooth scraping of the toner T and accurate regulation of the toner layer on the development roller 2 are attained. Furthermore, by making the rake face of the doctor blade 6 concave as shown in FIG. 5, smooth flow of the scraped toner along the rake face of the doctor blade 6 can be attained.

Referring back to FIG. 1, the developer container 4, the development roller 2, bucket wheel 3, doctor blade 6 and separator 7 are attached to an attachment plate 8, constituting a development unit.

In the attachment plate 8, there are formed two guide grooves 8*a* and 8*b* into which reference guide members 10 and 9 are respectively fitted in sliding contact with the reference guide members 10 and 9.

Figure 6:
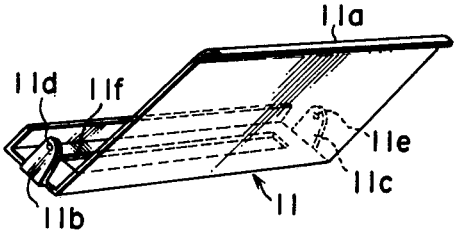
FIG. 6 is a perspective view of a slit exposure plate for use in the present invention.
Figure 7:
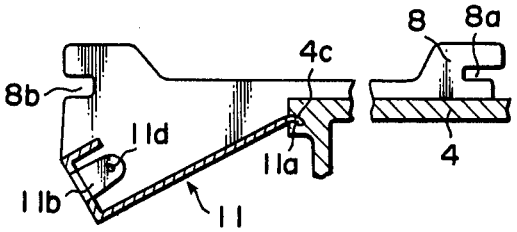
FIG. 7 is a cross section of the slit exposure plate shown in FIG. 6, which is fixed to part of a developer container shown in FIG. 1.

The slit exposure plate 11 is in the shape as shown in FIG. 6. Reference numeral 11*f* indicates a slit formed in the slit exposure plate 11. The upper bent portion 11*a* of the slit exposure plate 11 is fitted into a groove 4*c* formed in part of the developer container 4, while two bent attachment portions 11*b* and 11*c* formed in the lower bent portion of the slit exposure plate 11 are fixed to the attachment plate 8 by screws through attachment holes 11*d* and 11*e* respectively formed in the bent attachment portions 11*b* and 11*c* as shown in FIG. 7.

When the attachment plate 8 is pulled to the front side along the guide grooves 9 and 10, the slit exposure plate 11 can be detached from the body of the copying machine, together with the development unit which is integral with the attachment plate 8. After the attachment plate 8 is detached from the body of the copying machine, the slit exposure plate 11 can also be detached from the development unit when necessary.

When the development unit is reattached to the body of the copying machine, the slit exposure plate 11 and the development unit which includes the development roller 2 can be registered with high accuracy with respect to the photoconductor drum 1 and the rays of exposure light 12.

Figure 8:
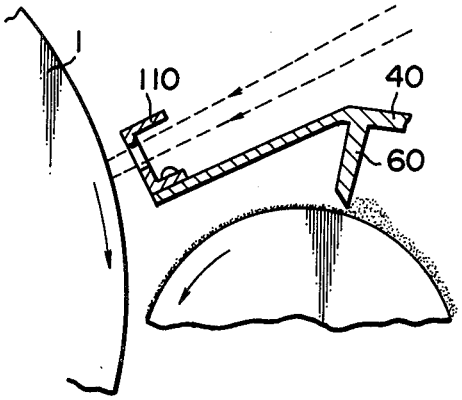
FIG. 8 is a cross section of a modified slit exposure plate for use in the present invention, which is also fixed to part of a developer container.

Referring to FIG. 8, there is shown a schematic cross section of a modified slit exposure plate 110 which is integrally formed with a developer container 40 and a doctor blade 60.

Figure 9:
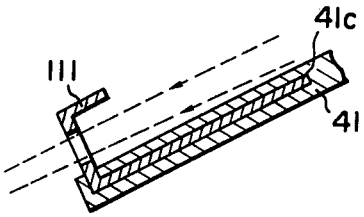
FIG. 9 is a cross section of another modified slit exposure plate for use in the present invention, which is also fixed to part of a developer container.

Referring to FIG. 9, there shown a schematic cross section of another modified slit exposure plate 111 which is tightly but detachably fitted into an L-shaped groove 41*c* formed in a developer container 41. This slit exposure plate 111 can be particularly firmly fixed to the developer container 41.

The drive shafts of the development roller 2 and the bucket wheel 3 are rotatably supported through a side wall of the developer container 4. Toner is apt to enter a conventional bearing portion of such a drive shaft and the side wall, hindering the rotation of the drive shaft.

Figure 10:
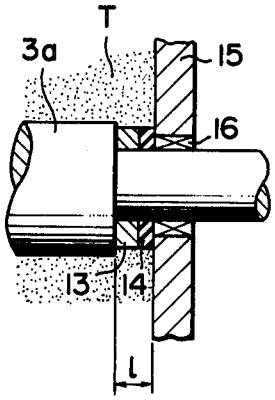
FIG. 10 is a partial cross section of an example of a shaft portion of a bucket wheel for use in the present invention.

In the present invention, however, a first shielding member 14 and a second shielding member 13 which are greater in diameter than the outer diameter of a bearing 16 are inserted between a step portion of the drive shaft 3*a* and the side wall 15, as shown in FIG. 10, whereby toner is prevented from entering the bearing 16. The first sealing member 14 is made of an elastic material, such as polyurethane foam, rubber or felt, which is in direct contact with the side wall 15 and the bearing 16. The second sealing member 13 is made of a non-elastic material, such as polyacetal, nylon or Teflon, and is disposed between the step portion of the drive shaft 3*a* and the first sealing material 12.

The first sealing member 14 and the second sealing member 13 are in the shape of rings, which can be two separate members or can be made in one piece by use of an adhesive. The first sealing member 13 is slightly depressed while in use between the side wall 15 and the second sealing member 14. For instance, if the total free thickness of the first and second sealing members 14 and 13 is 2.5 mm, the total depressed thickness while in use is 2 mm.

It is necessary that the first sealing member 13 be large enough to cover the bearing 16 completely and be stationary relative to the side wall 15 or be rotated at a speed smaller than the rotation speed of the drive shaft 3a, from the viewpoint of the life of the first sealing member 13.

The second sealing member 13 is in sliding contact with the step portion of the drive shaft 3a and it is necessary that the second sealing member 13 have resistance to frictional wear.

The use of such sealing members will also serve to minimize the shaking of the development roller 3 in the axial direction thereof.

Figure 11:
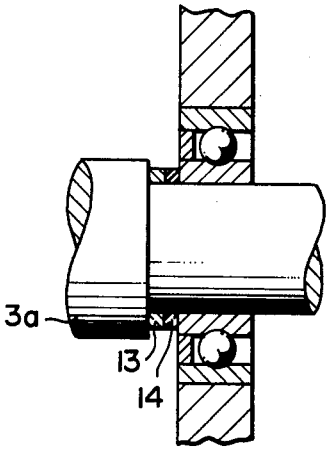
FIG. 11 is a partial cross section of another example of a shaft portion of a bucket wheel for use in the present invention.

As shown in FIG. 11, when a shielded bearing is employed, it is only necessary that the sealing members 14 and 13 cover the inner race of the bearing or the gap between the inner race and the drive shaft 3a.

As a matter of course, the above-described sealing materials 13 and 14 can also be applied to the drive shaft portion of the development roller 2.

What is claimed is:

1. In a dry type development apparatus comprising (1) a developer container for holding a two-component type toner therein, disposed near a photoconductor on which latent electrostatic images are formed, (2) a developer replenishment tank, (3) a development roller, disposed within said developer container, comprising a rotatable non-magnetic sleeve and inner magnets which are supported stationarily within said non-magnetic sleeve, said nonmagnetic sleeve being in proximity to the peripheral surface of said photoconductor and capable of forming a magnetic brush thereon from which the toner is supplied to the latent electrostatic image-bearing photoconductor for development of the latent images during the rotation of said non-magnetic sleeve, (4) a rotatable bucket wheel disposed near said developer roller in the development container, for supplying the toner to said development roller, which bucket wheel rotates and scoops up the toner which flows from a lower portion of said development roller along the bottom of said development container and supplies the scooped up toner to the development roller, and (5) a doctor blade which is fixed to a stationary portion of the development apparatus and is directed towards the peripheral surface of said non-magnetic sleeve of said development roller so as to form thereon a toner layer with a predetermined thickness by scraping the excess toner off said toner layer, the improvement wherein said development roller and said bucket wheel are rotated in the same direction, and the toner which flows from the lower portion of said developer roller to the lower buckets of said bucket wheel is carried upwards by said bucket wheel towards the upper portion of said development roller, and wherein said apparatus further comprises a separator which is disposed near to, but spaced apart from, said doctor blade and extends over said bucket wheel for guiding the toner scrapped off by said doctor blade away from the development roller onto said bucket wheel or to said developer container, and said doctor blade is disposed with a positive rake angle with respect to the perpendicular to the tangent to said development roller at a point of nearcontact therewith midway between a pair of inner magnets of said development roller, whereby the toner scraped off the toner layer by said doctor blade is carried onto said separator, and is returned onto said bucket wheel or to said development container, and, in the meantime, the toner deposited in the form of a toner layer on said development roller is carried to a development section of said photoconductor for development of latent electrostatic images formed on said photoconductor, and the excess toner which is not used for the development is carried below said development roller and is then carried along the bottom of said developer container towards said bucket wheel.

2. A dry type development apparatus as claimed in claim 1, wherein, of said inner magnets, at least two magnets disposed adjacent to each other in the lower portion of said development roller direct the same magnetic poles towards the inner peripheral surface of said non-magnetic sleeve to form a toner drop off area for the development roller.

3. A dry type development apparatus as claimed in claim 1, wherein said bucket wheel comprises a rotatable wheel and a plurality of buckets attached to said rotatable wheel.

4. A dry type development apparatus as claimed in claim 1, wherein said rotatable bucket wheel comprises a pair of flanges, a bucket by which said flanges are connected to each other, and a plurality of elliptical plates fitted in the cylindrical space of said bucket, with predetermined spaces therebetween and with a predetermined inclination with respect to said flanges.

5. A dry type development apparatus as claimed in claim 1, wherein at least said developer container said development roller, said bucket wheel, said doctor blade and said separator are attached to an attachment plate, thereby constituting developing unit is detachable from and reattachable to the body of said development apparatus under the guidance of guide means.

6. In a dry type development apparatus comprising (1) a developer container for holding a two-component type toner therein, disposed near a photoconductor on which latent electrostatic images are formed, (2) a developer replenishment tank from which new two-component type toner is replenished to said developer container, (3) a development roller, disposed within said developer container, comprising a rotatable non-magnetic sleeve and inner magnets which are supported stationarily within said non-magnetic sleeve, said non-magnetic sleeve directed towards the peripheral surface of said photoconductor and capable of forming a magnetic brush thereon from which the toner is supplied to the latent-electrostatic-image-bearing photoconductor for development of the latent images during the rotation of said non-magnetic sleeve, (4) a rotatable bucket wheel disposed near said development roller in the developer container, for supplying the toner to said development roller, which bucket wheel rotates and scoops up the toner which flows from a lower portion of said development roller along the bottom of said developer container and supplies the scooped up toner to the development roller, (5) a doctor blade which is fixed to a stationary portion of the development apparatus and is directed towards the peripheral surface of said non-magnetic sleeve of said development roller so as to form thereon a toner layer with a predetermined thickness by scraping the excess toner off said toner layer, and (6) a separator which is disposed near said doctor blade and extends over said bucket wheel in order to guide the toner scraped off by said doctor blade onto said bucket wheel or to said developer container, at least said developer container and said development roller being attached to an attachment plate member, thereby constituting a development unit, which development unit is detachable from and reattachable to the body of said development apparatus under the guidance of guide means, the improvement wherein a slit exposure plate for forming latent electrostatic images on the surface of said photoconductor is integral with said development unit and is also detachable from said development unit.

7. A dry type development apparatus as claimed in claim 6, wherein one end portion of said slit exposure plate is fitted into a groove formed in part of said developer container, while the other end portion of said slit exposure plate is fixed to said attachment plate member.

8. A dry type development apparatus as claimed in claim 6, wherein said slit exposure plate is integral with said developer container.

9. In a dry type development apparatus comprising (1) a developer container for holding a two-component type toner therein, disposed near a photoconductor on which latent electrostatic images are formed, (2) a developer replenishment tank, (3) a development roller, disposed within said developer container, comprising a rotatable non-magnetic sleeve and inner magnets which are supported stationarily within said non-magnetic sleeve, said non-magnetic sleeve being in proximity to the peripheral surface of said photoconductor and capable of forming a magnetic brush thereon from which the toner is supplied to the latent electrostatic imagebearing photoconductor for development of the latent images during the rotation of said non-magnetic sleeve, (4) a rotatable bucket wheel disposed near said developer roller in the development container, for supplying the toner to said development roller, which bucket wheel rotates and scoops up the toner which flows from a lower portion of said development roller along the bottom of said development container and supplies the scooped up toner to the development roller, (5) a doctor blade which is fixed to a stationary portion of the development apparatus and is directed towards the peripheral surface of said non-magnetic sleeve of said development roller so as to form thereon a toner layer with a predetermined thickness by scraping the excess toner off said toner layer, and (6) a separator which is disposed near said doctor blade and extends over said bucket wheel in order to guide the toner scraped off by said doctor blade onto said bucket wheel or to said developer container, the improvement wherein said development roller and said bucket wheel are rotated in the same direction, and the toner which flows from the lower portion of said developer roller to the lower buckets of said bucket wheel is carried upwards by said bucket wheel towards the upper portion of said development roller, and the toner scraped off the toner layer by said doctor blade is carried onto said separator and is returned onto said bucket wheel or to said development container, and, in the meantime, the toner deposited in the form of a toner layer on said development roller is carried to a development section of said photoconductor for development of latent electrostatic images formed on said photoconductor, and the excess toner which is not used for the development is carried below said development roller and is then carried along the bottom of said developer container towards said bucket wheel, and further wherein said doctor blade is disposed with a positive rake angle with respect to the perpendicular to the tangent to said development roller at its point of near-contact therewith midway between said inner magnets of said development roller, and includes a concave portion in the rake face thereof for guiding scraped toner onto said separator.

10. In a dry type development apparatus comprising (1) a developer container for holding a two-component type toner therein, disposed near a photoconductor on which latent electrostatic images are formed, (2) a developer replenishment tank, (3) a development roller, disposed within said developer container, comprising a rotatable non-magnetic sleeve and inner magnets which are supported stationarily within said non-magnetic sleeve, said non-magnetic sleeve being in proximity to the peripheral surface of said photoconductor and capable of forming a magnetic brush thereon from which the toner is supplied to the latent electrostatic imagebearing photoconductor for development of the latent images during the rotation of said non-magnetic sleeve, (4) a rotatable bucket wheel disposed near said developer roller in the development container, for supplying the toner to said development roller, which bucket wheel rotates and scoops up the toner which flows from a lower portion of said development roller along the bottom of said development container and supplies the scooped up toner to the development roller, (5) a doctor blade which if fixed to a stationary portion of the development apparatus and is directed towards the peripheral surface of said non-magnetic sleeve of said development roller so as to form thereon a toner layer with a predetermined thickness by scraping the excess toner off said toner layer, and (6) a separator which is disposed near said doctor blade and extends over said bucket wheel in order to guide the toner scraped off by said doctor blade onto said bucket wheel or to said developer container, the improvement wherein said development roller and said bucket wheel are rotated in the same direction, and the toner which flows from the lower portion of said developer roller to the lower buckets of said bucket wheel is carried upwards by said bucket wheel towards the upper portion of said development roller, and the toner scraped off the toner layer by said doctor blade is carried onto said separator and is returned onto said bucket wheel or to said development container, and, in the meantime, the toner deposited in the form of a toner layer on said development roller is carried to a development section of said photoconductor for development of latent electrostatic images formed on said photoconductor, and the excess toner which is not used for the development is carried below said development roller and is then carried along the bottom of said developer container towards said bucket wheel, and further wherein said separator comprises (i) an upper plate which is curved in the middle so as to allow the toner to move along said upper plate and to drop over said bucket wheel, and which includes an opening at one end portion thereof, (ii) a plurality of fins formed in the curved-down portion of said upper plate, which are arranged parallel to each other but inclined so as to guide the toner laterally with respect to the initial flow of the toner along said upper plate, (iii) a conduit disposed below said upper plate and leading from said opening and extending along said upper plate, for allowing the toner which enters said conduit from said opening to pass therethrough, and (iv) a screw conveyor disposed within said conduit for carrying the toner from one end portion of said conduit to the other end portion thereof.

* * * * *

UNITED STATES PATENT AND TRADEMARK OFFICE

CERTIFICATE OF CORRECTION

PATENT NO. : 4,449,810

DATED : May 22, 1984

INVENTOR(S) : MASUMI IKESUE and NOBUYUKI YANAGAWA

It is certified that error appears in the above-identified patent and that said Letters Patent is hereby corrected as shown below:

Claim 10, line 23, column 12, change "if" to --is--.

Signed and Sealed this

*Sixteenth* Day of *April 1985*

[SEAL]

*Attest:*

DONALD J. QUIGG

*Attesting Officer* *Acting Commissioner of Patents and Trademarks*